United States Patent [19]

Schaaf et al.

[11] Patent Number: 4,711,598

[45] Date of Patent: Dec. 8, 1987

[54] BEACH EROSION CONTROL DEVICE

[76] Inventors: Cecil Schaaf; Craig Schaaf, both of 3015 Palmer Rd., Standish, Mich. 48658

[21] Appl. No.: 912,752

[22] Filed: Sep. 26, 1986

[51] Int. Cl.[4] ..... E02B 3/04; E02B 3/06

[52] U.S. Cl. ..... 405/30; 405/21; 405/35

[58] Field of Search ..... 405/21, 23, 25, 30, 405/31, 33, 34, 35

[56] References Cited

U.S. PATENT DOCUMENTS

| | | | |
|---|---|---|---|
| 2,069,715 | 2/1937 | Arpin | 405/25 |
| 3,490,239 | 1/1970 | Vincent | 405/31 |
| 3,733,831 | 5/1973 | Sticker, Jr. | 405/30 |
| 4,269,537 | 5/1981 | O'Neill | 405/33 |
| 4,367,978 | 1/1983 | Schaaf et al. | 405/21 |
| 4,407,608 | 10/1983 | Hubbard | 405/25 |
| 4,498,805 | 2/1985 | Weir | 405/31 |
| 4,502,816 | 3/1985 | Creter, Jr. et al. | 405/21 |

FOREIGN PATENT DOCUMENTS

| | | | |
|---|---|---|---|
| 407575 | 3/1910 | France | 405/30 |
| 0168805 | 9/1985 | Japan | 405/35 |
| 478094 | 7/1975 | U.S.S.R. | 405/30 |

*Primary Examiner*—Nancy J. Stodola

*Attorney, Agent, or Firm*—Cullen, Sloman, Cantor, Grauer, Scott & Rutherford

[57] ABSTRACT

A concrete module for at least partial submergence in the surf to dissipate the energy of wave action and to promote the deposition of beach-restoring sand and pebbles comprises a series of passages which converge toward the shore-facing side of the module and terminate in an upwardly-directed opening which deflects the incoming water flow upward to further dissipate the wave energy and to create a reaction force on the module which tends to rotate or tilt it toward the shore. This tendency aids in neutralizing the natural tendency of barriers to rotate toward the sea as a result of sand being scoured out from beneath the seaward side of the barrier as a result of downwardly-deflected incoming wave energy.

6 Claims, 4 Drawing Figures

BEACH EROSION CONTROL DEVICE

BACKGROUND OF THE INVENTION

The present invention relates to modules adapted to be placed in side-by side relation in the surf to define an off-shore reef-like barrier which protects beaches against erosion and causes deposition of sand and pebbles to restore and build up the shoreline. This device is an improvement over our earlier module disclosed in U.S. Pat. No. 4,367,978 and the prior art referred to therein.

While the module of our prior patent proved to be effective in dissipating the energy of the incoming surf and in causing the deposition of waterborne sand, certain aspects of its design tended to cause scouring of sand from the bottom beneath and immediately adjacent to the module. First, there is a natural tendency for barriers in the water to rotate seaward (i.e., the top of the barrier tends to tilt toward the sea) because part of the energy of the incoming surf is deflected downward and scours away the supporting sand beneath the seaward edge of the barrier. Secondly, the central opening in the bottom of our previously patented module, which was intended to aid in anchoring the module to the sea bottom, tended to cause further scouring of sand from beneath the module.

Thirdly, the flap-like valve member of our previously patented module tended to cause too much back pressure on the module from the return flow of water toward the sea. This pressure increased the tendency of the module to rotate seaward and also could cause sufficient forces to push a module out of alignment with its neighboring modules. By excessively reducing the available flow path for returning water through the module, such flow was diverted into the spacing between adjacent modules. The increased velocity through these restricted spaces caused additional scouring of the sand from both the shoreward and seaward sides of the module.

All of these phenomena described above tended to cause misalignment of the row of modules or to cause the modules to sink too deeply into the bottom, thereby decreasing their effectiveness.

While modules having a generally similar shape to those described in our prior patent have been made without the central bottom opening, the planar uninterrupted bottom of such modules was unable to adequately anchor the module to the sea bottom.

Accordingly, it is the primary object of the present invention to provide an improved module which effectively dissipates the energy of the surf, causes deposition of sand to restore or build up the shoreline, and also minimizes the tendency of the energy of the moving water to scour sand from beneath and around the module. Furthermore, it is an object of the present invention to provide means for effectively anchoring or stabilizing the position of the module on the sea bottom, without causing it to sink excessively into the sea bottom.

SUMMARY OF THE INVENTION

The distinctive feature of our present module, as compared with our previously patented module, is the provision of a flow-deflecting surface on the shoreward end of each passage through the module. This deflector is inclined in a direction to cause the incoming surf to be deflected sharply upwardly as it exits from the shoreward end of each passage. This upward deflection is advantageous for several reasons. First, it considerably enhances the energy-dissipating capacity of the module. Secondly, the reaction force against such deflector surface caused by the redirected water flow produces a counter-rotation force which tends to rotate the top of the module shoreward. This force therefore tends to neutralize the seaward rotation tendency caused by scouring of sand from beneath the seaward side of the module. The placement of these deflectors at the extreme shoreward end of each passage maximizes the leverage available from these reaction forces, thereby maximizing this rotational effect. Finally, these deflectors additionally function to provide maximum turbulence or restriction against return flow through the passageways toward the sea, thereby aiding in causing water-borne sand to be deposited on the shoreward side of the module.

The central bottom opening in the module has been eliminated. In its place, downwardly projecting formations along the seaward and shoreward edges of the module have been added to embed into the sea bottom and form an interlock or anchor to resist the tendency of the hydrodynamic forces to displace the module from its proper alignment with neighboring modules. These projections also provide a space under the central portion of the module which permits access for ease of movement on land by means of a fork lift truck.

DETAILED DESCRIPTION OF THE INVENTION

Figure 1:
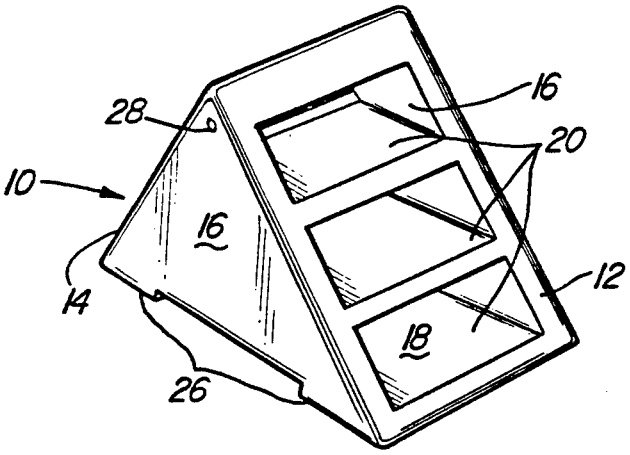
FIG. 1 is a perspective view of the module viewed from the seaward side.
Figure 2:
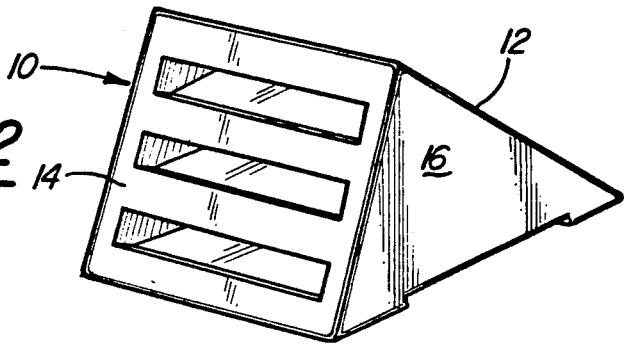
FIG. 2 is a perspective view of the module viewed from the shoreward side.
Figure 3:
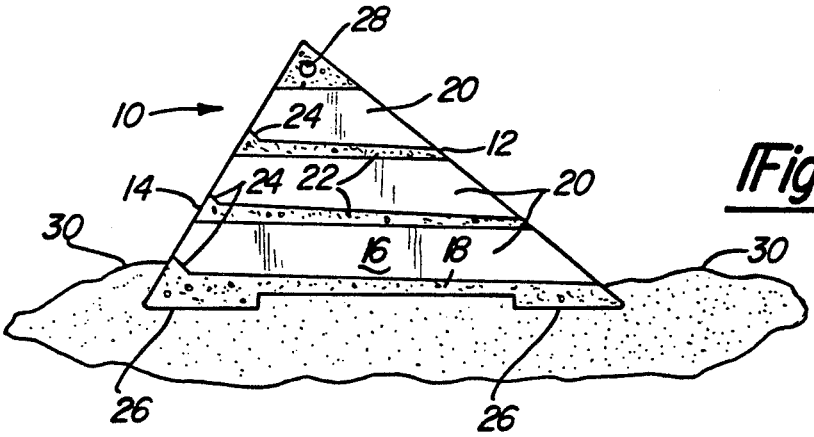
FIG. 3 is a side cross-sectional view of the module shown in place on the sea bottom.

Referring to FIGS. 1–3 of the drawings, there is illustrated a module 10 which generally comprises a front or seaward wall 12, a rear or landward wall 14, a pair of sidewalls 16 and bottom wall or floor 18. The front and rear walls are oppositely inclined and converge upwardly, and it will be seen from FIG. 3 that front wall 12 is less steeply inclined than is rear wall 14 to enhance its ability to survive the impact of the incoming surf during stormy conditions. The steeper rear wall also aids in slowing the seaward return flow, thereby causing water-borne sand and pebbles to drop to the sea bottom.

A series of three vertically spaced passages interconnect the front and rear walls, these passages being separated by generally horizontal partitions 22. As is described in our earlier patent, the cross-sectional area of these passages progressively decreases from the front toward the rear wall of the module, to aid in dissipating the energy of the incoming surf while increasing the restriction to return flow. The lower surfaces of each passage are inclined slightly upwardly from the front toward the rear of the module. This configuration, as described in our earlier patent, causes the hydrodynamic forces of the incoming surf to generate a downward component on the module which increases the stability of the module and aids it in maintaining its position against the impact of the surf.

As best shown in FIG. 3, the terminal portion of each passage adjacent rear wall 14 has a sharply upwardly inclined deflecting surface 24. Deflectors 24 function to redirect the incoming water flow upwardly as the flow exits the passages. This redirection of the flow consumes much of the energy of the flow and redirects it harmlessly upwardly, thereby enhancing the beach-protecting function of the module.

The redirection of the incoming water also generates a reaction force against deflectors 24, tending to push downwardly and to the left (as viewed in FIG. 3) against the module. The placement of these deflectors at the extreme rearward or leftward end of the passages maximizes the leverage of these forces to create a shoreward rotational effect upon the module. That is, the module tends to rotate in the counterclockwise direction as viewed in FIG. 3. This shoreward rotational force is desirable because it acts to neutralize seaward rotation which tends to result from scouring of sand beneath the seaward edge of the module by the downward deflection of the incoming wave energy along the seaward face of any barrier.

These deflectors 24 also function to sharply restrict the cross-sectional area of passages 20 on the shoreward or rear face of the module. In conjunction with the relatively steep incline of rear wall 14, this configuration results in maximum retarding effect on the return flow of the water toward the sea. The reduced velocity causes suspended sand or fine pebbles to be deposited on the shoreward side of the module, thus restoring and increasing the height and width of the beach.

As best shown in FIG. 3, a pair of downwardly projecting anchoring formations 26 are provided on the underface of bottom wall 18. These formations preferably extend the full width of the module, one along the front of the module and one along the rear. Formations 26 tend to "bite" or dig into the sea bottom, thereby enhancing the ability of the module to maintain its position in spite of the impacting forces of the surf. The space between formations 26 also provides convenient access for the forks of a fork lift truck to move the modules when they are on land.

A cable access hole 28 is provided near the top of the module, this hole extending entirely through the module between sidewalls 16. A positionstabilizing cable or tube can be passed through the aligned holes of adjacent modules to aid in maintaining the alignment of the row of modules during the period immediately following installation in the surf, before the modules have had an opportunity to embed themselves into the sea bottom. Additionally, lifting straps or cables can be passed through holes 28, or through passages 20, by means of which the modules can be transported by helicopter or barge-mounted crane into their final position in the surf.

As will be seen in FIG. 3, a build-up of sand or fine gravel, resulting from the interaction of the module with the water flow, is shown at 30 adjacent the front and rear walls of the module.

Figure 4:
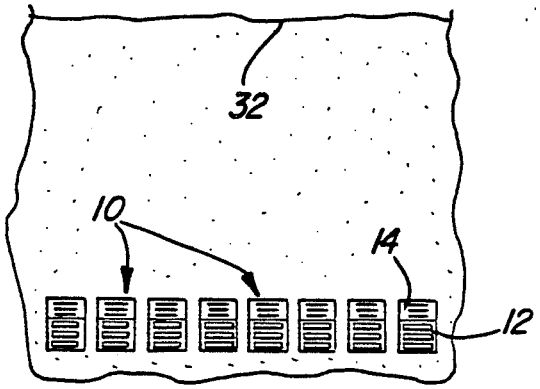
FIG. 4 is a fragmentary plan view of a segment of shoreline with a row of modules placed in the surf area.

In FIG. 4, there is shown in plan view a segment of shoreline 32 and a row of modules 10 located in the surf zone offshore. The modules are preferably spaced about six inches apart.

In a preferred embodiment, the modules are cast from concrete and have a height and width (from sidewall to sidewall) of approximately 4 feet and a base dimension from the bottom of front wall 12 to the bottom of rear wall 14 of approximately 7 feet. It is preferred that a module of this size be placed at a point in the surf where the average depth is approximately two-and-one-half feet deep.

In the preferred embodiment, the angle of deflector surface 24 relative to the bottom of adjacent passage 20 is about fifty-five degrees (i.e., relative to an imaginary extension of such passage bottom). Angles in the range of about thirty-five to sixty-five degrees may also be useful. Too large an angle creates excessive obstruction to flow and high impact forces, while too shallow of an angle is less effective to generate shoreward rotation forces and to retard the return flow. The upward incline of the bottom face of the passages is preferably about five degrees from the horizontal, and that of the top face is about one and one-half degrees.

Although the term "sea" has been used herein, it is contemplated that these modules may be used in lakes or any other body of water where wave or current energy tends to cause shoreline erosion.

This invention may be further developed within the scope of the following claims. Accordingly, the above specification is to be interpreted as illustrative of only a single operative embodiment of the present invention, rather than in a strictly limited sense.

We now claim:

1. In a device for protecting shoreline from erosion of the type characterized by a generally prism-shaped module intended to be positioned on a surf-area floor and at least partially submerged in the surf, and having a seaward-facing front wall and a landward-facing rear wall, the module having at least one passage extending therethrough from the front wall to the rear wall, the passage having a lower surface over which water flows as it passes through the passage, the passage having a smaller cross-sectional area at its opening in the rear wall than in the front, the improvement which comprises:

the lower surface of the portion of the passage immediately adjacent the rear wall opening defining a deflector which is upwardly and rearwardly inclined at an angle of between about 35 and 65 degrees relative to the lower surface of the forwardly-located adjacent portion of the passage;

whereby said deflector surface causes landwardly flowing water in the passage to be deflected upwardly as it exits the rear wall opening of the passage.

2. The module of claim 1 wherein said front and rear walls are oppositely inclined and upwardly converging.

3. The module of claim 1 which further comprises a bottom wall which is imperforate and has a non-planar underside with projecting formations to assist in anchoring the module to the surf-area floor.

4. A modular device for protecting shoreline from erosion when arrayed on a surf-area floor as part of a line of such devices oriented generally perpendicularly to the direction of incoming waves, comprising:

a seaward-facing front wall and a landward-facing rear wall, said front and rear walls being oppositely inclined and upwardly converging, a plurality of vertically spaced passages each extending through said device from a front opening in said front wall to a rear opening in said rear wall, at least one of said passages having a lower surface over which water flows as it passes through said one passage, said lower surface of said one passage having a deflector surface immediately adjacent said rear wall opening which is upwardly and rearwardly inclined at an angle of between about 35 and 65 degrees relative to said lower surface of the forwardly-located adjacent portion of said one passage;

whereby when said device is placed on the surf-area floor so that landward-flowing wave energy flows through said one passage, the erosion-causing impact of the waves is significantly dissipated as a result of the upward deflection of the water flow by said deflector surface as the water flow exits said rear wall opening of said one passage.

5. The device of claim 4 wherein said rear wall opening of each of said passages has a smaller cross-sectional area than that of said front wall opening of such passage, thereby tending to increase the retarding effect of said passages upon seaward return flow of water therethrough.

6. The device of claim 4 which further comprises a bottom wall which is imperforate and has a non-planar underside with projecting formations to assist in anchoring the device to the surf-area floor.

* * * * *